US007955121B2

(12) United States Patent
Sattazahn et al.

(10) Patent No.: US 7,955,121 B2
(45) Date of Patent: Jun. 7, 2011

(54) ELECTRICAL CONNECTOR ASSEMBLY HAVING A CABLE RETENTION ELEMENT

(75) Inventors: Steve Sattazahn, Lebanon, PA (US); Stephen Apa, Lewisberry, PA (US); David Cours, Dalton, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 77 days.

(21) Appl. No.: 12/477,645

(22) Filed: Jun. 3, 2009

(65) Prior Publication Data

US 2010/0311269 A1 Dec. 9, 2010

(51) Int. Cl.
*H01R 13/58* (2006.01)

(52) U.S. Cl. ..... 439/471; 439/455

(58) Field of Classification Search ..... 439/471, 439/449, 453, 455, 464, 466, 468, 470, 473, 439/736

See application file for complete search history.

(56) References Cited

U.S. PATENT DOCUMENTS 4,990,103 A * 2/1991 Sazaki et al. ..... 439/455
5,180,316 A 1/1993 Miller et al.
5,334,044 A 8/1994 Falossi et al.
5,462,457 A 10/1995 Schroepfer et al.
5,600,885 A 2/1997 Schroepfer et al.
6,220,888 B1 4/2001 Correa
6,257,920 B1 7/2001 Finona et al.
6,793,520 B1 9/2004 Wu

OTHER PUBLICATIONS

Machine Applied Terminations, Open Barrel Terminals, (Rings, Spades, Pins, Receptacles, Splices, Tabs), Catalog 82227, Revised Aug. 2004, 76 pages.
Metric, Strain Relief Wing Type, 1 pg.

* cited by examiner

*Primary Examiner* — Javaid Nasri

(57) ABSTRACT

An electrical connector assembly includes a housing, a cable and a cable retention element. The housing holds contacts that are configured to be electrically joined with a peripheral device. The housing includes a cable port that is disposed at an outer surface of the housing. The cable extends from the cable port of the housing along a cable axis. The cable is electrically coupled with the contacts in the housing. The cable retention element is attached to the cable and is at least partially disposed within the housing. The cable retention element includes a body that is joined with the cable and a wing protruding from the body in a direction oriented at an angle with respect to the cable axis. The wing engages the housing to prevent the cable from being removed from the housing.

24 Claims, 3 Drawing Sheets

ELECTRICAL CONNECTOR ASSEMBLY HAVING A CABLE RETENTION ELEMENT

BACKGROUND OF THE INVENTION

The subject matter herein relates generally to electrical connectors and, more particularly, for electrical connectors that are coupled with one or more cables.

Some known electrical connectors are joined with cables to electrically couple the connectors with the cables. For example, the connectors may include contacts that engage a peripheral device. The contacts electrically join the connector with the peripheral device. The cable typically includes one or more conductors extending along the interior of the cable throughout the length of the cable. The cable is connected with the connector with the conductors electrically terminated with the contacts to electrically couple the cable with the contacts. Thus, the connector electrically connects the peripheral device with the cable. Electrical power and/or signals may then be communicated between the peripheral device and the cable. In applications where the peripheral device is a solar module or panel, the connector may communicate electric potential or current from the solar module or panel to another external or peripheral device via the cable.

In some applications, the cables joined with the connectors may experience significant forces that pull the cable away from the connector. For example, environmental factors such as ice and snow may add weight to cables joined to connectors mounted on solar panels. This additional weight may pull the cables away from the connectors. If the cables are not affixed to the connectors in a sufficiently strong manner, the cables may become detached from the connectors. That is, one or more of the conductors in the cables can separate from the contacts in the connector, thereby disrupting an electrically conductive path extending from the contacts to the cable conductors.

Some industry standard-setting organizations such as Underwriters Laboratories Inc. set forth standards for cable retention mechanisms. For example, the organizations may require that a cable joined with a connector mounted to a solar panel be able to withstand a minimum force applied to the cable without separating or removing the cable from the connector. Some known connectors do not meet these standards. For example, the cables of some known connectors may separate from the connectors when the minimum force required by industry standards is applied to the cables. Other known connectors meet the industry standards, but include retention mechanisms that are relatively large. For example, some known solar module connectors include pinch ring and nut combinations to secure cables to the connectors. The pinch ring is a ring that is placed around the cable. The pinch ring includes several slots that permit the ring to be compressed down onto the cable. The nut is placed into the connector. The pinch ring is screwed into the nut to compress the pinch ring onto the cable and to couple the cable with the connector. The pinch ring is compressed around the cable when the nut is screwed down or tightened onto the connector. But, the size of the nut limits the size of the connector. That is, the size of the connector typically must be at least as large as the nut. As a result, the profile height of the connector is limited by the size of the nut. In certain applications, the size of the nut may require the connector to have a profile height that is too large. For example, the location in which some solar module connectors are required may be too small to fit a connector having a nut and pinch ring combination.

Thus, a need exists for a connector assembly that affixes cables to connectors in such a manner to increase the force required to separate the cables from the connectors while maintaining a relatively small profile height of the connector.

BRIEF DESCRIPTION OF THE INVENTION

In one embodiment, an electrical connector assembly is provided. The connector assembly includes a housing, a cable and a cable retention element. The housing holds contacts that are configured to be electrically joined with a peripheral device. The housing includes a cable port that is disposed at an outer surface of the housing. The cable extends from the cable port of the housing along a cable axis. The cable is electrically coupled with the contacts in the housing. The cable retention element is attached to the cable and is at least partially disposed within the housing. The cable retention element includes a body that is joined with the cable and a wing protruding from the body in a direction oriented at an angle with respect to the cable axis. The wing engages the housing to prevent the cable from being removed from the housing. Optionally, the wing of the cable retention element is encapsulated in the housing. In one embodiment, the direction in which the wing extends from the body of the cable retention element is approximately perpendicular to the cable axis.

In another embodiment, another electrical connector is provided. The connector assembly includes a housing, a cable and a cable retention element. The housing holds contacts that are configured to be electrically joined with a peripheral device. The housing includes a cable port disposed at an outer surface of the housing. The cable extends from the cable port of the housing and is electrically coupled with the contacts in the housing. The cable retention element is attached to the cable and is at least partially disposed within the housing. The cable retention element includes wings protruding from the cable retention element to corresponding outer wing ends. A wingspan extending from one outer wing end to another outer wing end is greater than an inside diameter of the cable port. Optionally, the wings protrude from the cable retention element in opposite directions. The housing may include a mounting side that is configured to be mounted to the peripheral device and an opposite top side. The directions in which the wings protrude from the cable retention element may extend between the mounting side and the top side of the housing.

DETAILED DESCRIPTION OF THE INVENTION

Figure 1:
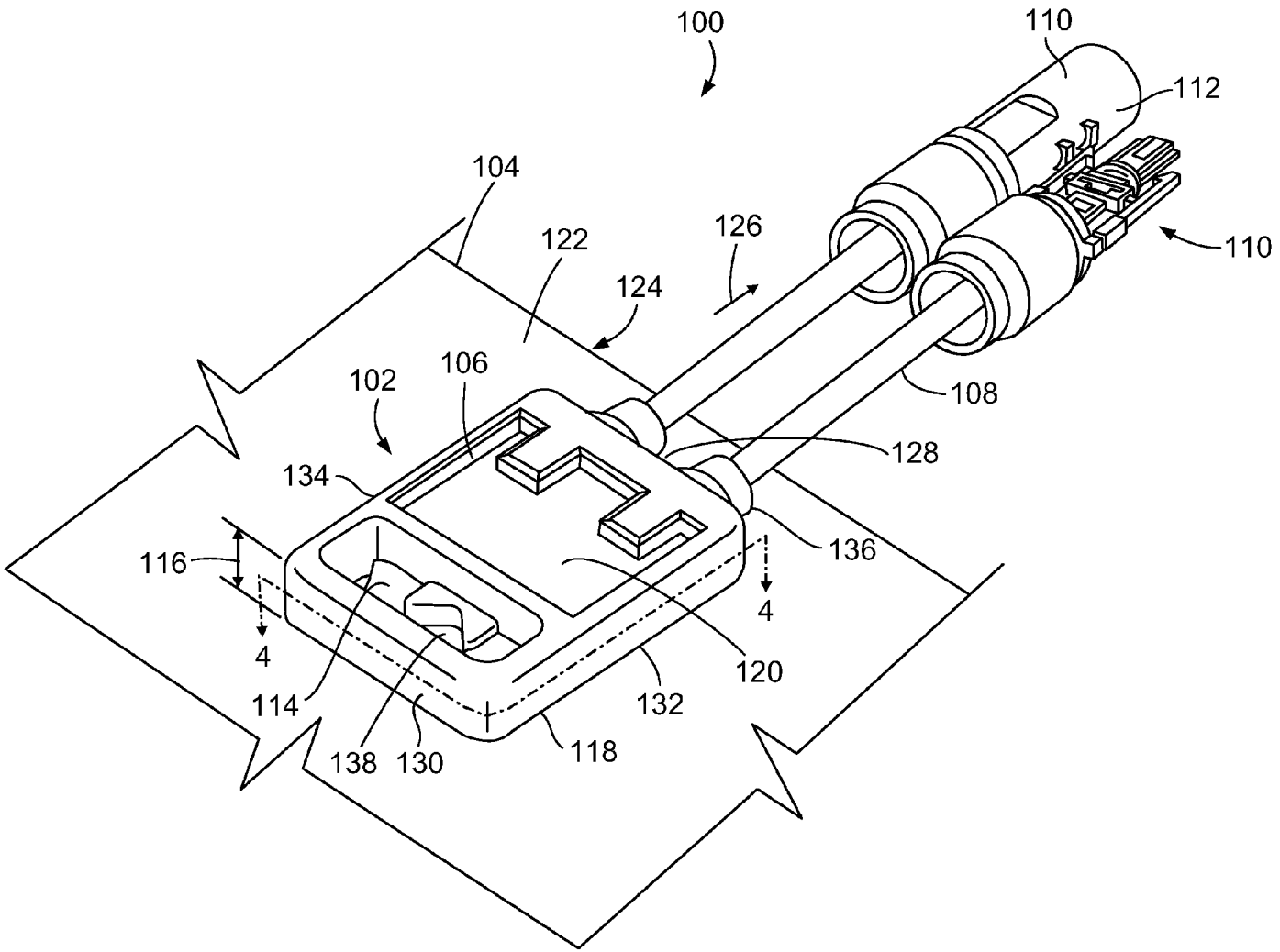
FIG. 1 is a perspective view of an electrical connector system in accordance with one embodiment.

FIG. 1 is a perspective view of an electrical connector system 100 in accordance with one embodiment. The system 100 includes an electrical connector assembly 102 mounted to a peripheral device 104. In the illustrated embodiment, the system 100 is a solar module system with the peripheral device 104 being a solar module and the connector assembly 102 is a connector that is mounted to and electrically coupled with the solar module. Alternatively, the system 100 may be a connector system other than a solar module system. While the discussion herein focuses on the system 100 being a solar module system, one or more embodiments described below may be used with connector systems other than a solar module system.

The connector assembly 102 includes a housing 106 that is joined to several cables 108. While two cables 108 are coupled with the housing 106 in the illustrated embodiment, a different number of cables 108 may be provided. For example, a single cable 108 or three or more cables 108 may extend out of the housing 106. The housing 106 includes contacts 114 that are electrically coupled with the peripheral device 104. In the illustrated embodiment, the contacts 114 are joined with contact tabs (not shown) protruding from the peripheral device 104. Electric potential or current generated in the peripheral device 104 is communicated to the connector assembly 102 via the contacts 114. The cables 108 extend from the housing 106 to plug ends 110. One of the plug ends 110 shown in FIG. 1 includes a cover 112 while the other plug end 110 is shown with the cover 112 removed. The plug ends 110 may be connected with another peripheral device (not shown) or an additional connector assembly 102 to electrically join the peripheral device 104 with the other peripheral device or additional connector assembly 102. Electrical potential or current generated in the peripheral device 104 is communicated with the other peripheral device or additional connector assembly 102 via the connector assembly 102.

The housing 106 extends along a profile height dimension 116 from a mounting side 118 to an opposite top side 120. The mounting side 118 and top side 120 are interconnected by four ends 128-134. First and second ends 128, 130 are approximately parallel to one another while third and fourth ends 132, 134 are approximately parallel to one another. Each of the first end 128 and the second end 130 intersects the third and fourth ends 132, 134. In the illustrated embodiment, each of the mounting side 118 and the top side 120 are located in separate planes that are approximately parallel to one another. The ends 128-134 are approximately perpendicular to the planes of the mounting side 118 and top side 120. The profile height dimension 116 is measured in a direction that extends approximately perpendicular to the mounting side 118 and the top side 120. The mounting side 118 is mounted to a mounting surface 122 of the peripheral device 104. The mounting surface 122 may be opposite of a light incident surface 124 of the peripheral device 104. The light incident surface 124 is the side of the peripheral device 104 that receives light to generate electric potential or current.

In the illustrated embodiment, housing 106 includes a cable port 136 along the outer surface of the housing 106 for each of the cables 108. As shown in FIG. 1, the cable ports 136 may be disposed along the first side 128 of the housing 106. Alternatively, one or more of the cable ports 136 may be disposed in a different end 130-134 of the housing 106. The cables 108 extend from the housing 106 along respective cable axes 126. Alternatively, one or more of the cables 108 may extend from a different end 130-134 of the housing 106. The cable axes 126 may extend approximately parallel to the planes in which the mounting side 118 and top side 120 of the housing 106 are located and approximately perpendicular to the first end 128.

The housing 106 frames a contact window 138 that is an opening extending through the housing 106 from the mounting side 118 to the top side 120. The contacts 114 are disposed within the contact window 138. The contact window 138 permits visual alignment of the contacts 114 with corresponding contacts (not shown) of the peripheral device 104 during assembly of the system 100. The contact window 138 may be filled with an encapsulant or potting compound to seal the contacts 114 in the housing 106. The contacts 114 may be sealed in the contact window 138 to protect the contacts 114 from external environmental factors such as heat and moisture. Alternatively, a cover (not shown) may be used to enclose the contact window 138 from outside environmental factors.

Figure 2:
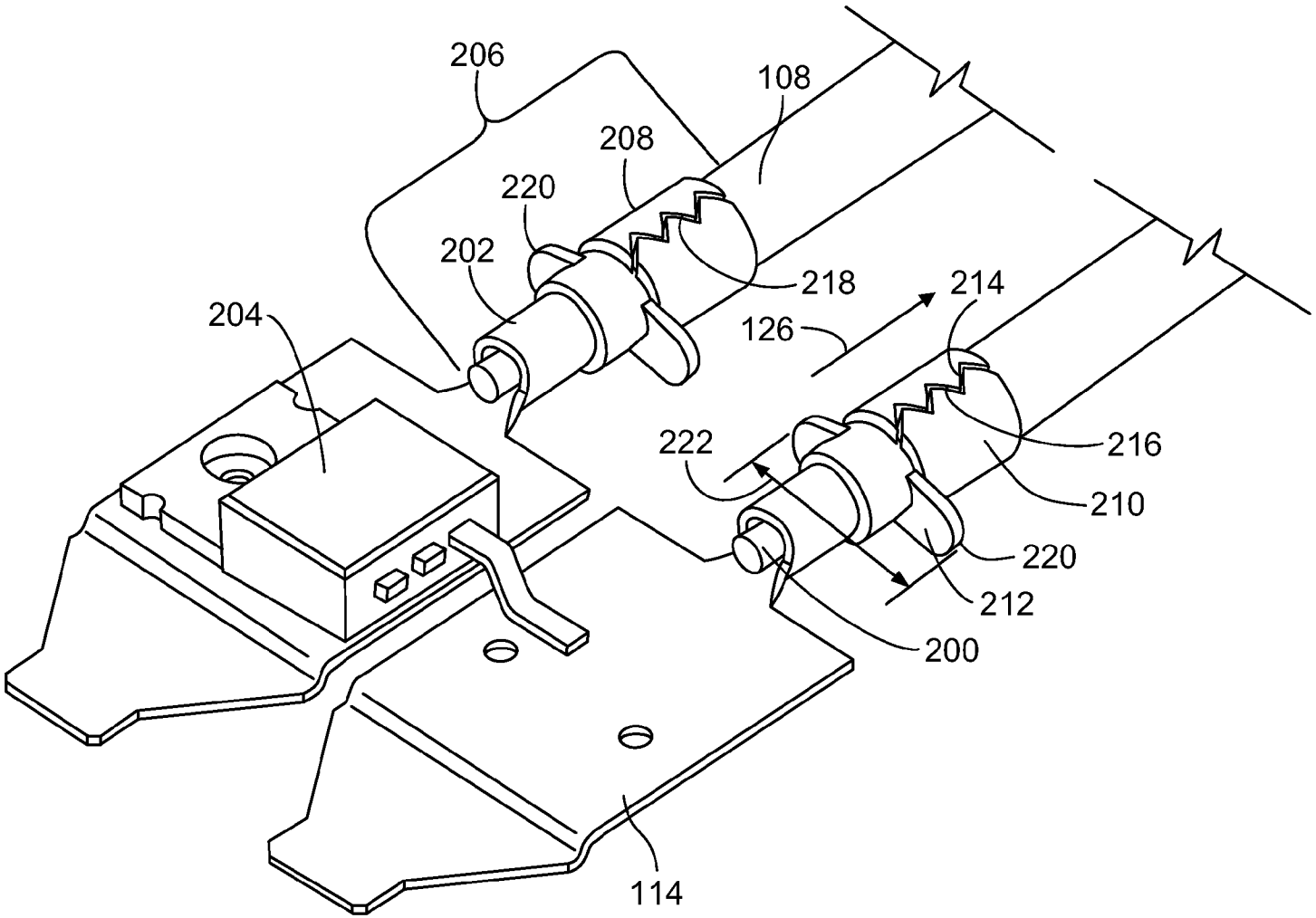
FIG. 2 is a perspective view of contacts and cables of a connector assembly shown in FIG. 1 in accordance with one embodiment.
Figure 3:
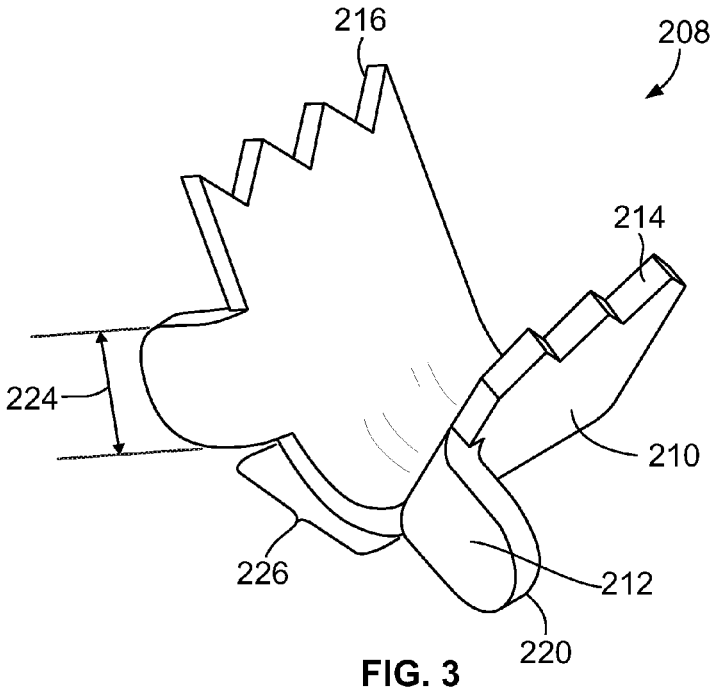
FIG. 3 is a perspective view of a cable retention element shown in FIG. 2 in accordance with one embodiment.

FIG. 2 is a perspective view of the contacts 114 and cables 108 of the connector assembly 102 (shown in FIG. 1) with the housing 106 (shown in FIG. 1) removed in accordance with one embodiment. FIG. 3 is a perspective view of the cable retention element 208 in an uncrimped position in accordance with one embodiment. The cables 108 include conductors 200 that extend along the corresponding lengths of the cables 108. The conductors 200 are joined with the contacts 114. For example, the contacts 114 may include a crimping portion 202 that is crimped to the contacts 114 to electrically couple the contacts 114 with the conductors 200. An electrical component 204 is mounted to and electrically connected with the contacts 114. In one embodiment, the electrical component 204 is a diode that permits the flow of electric current from the peripheral device 104 (shown in FIG. 1) in a single direction through the contacts 114 and cables 108.

An end portion 206 of each cable 108 includes a cable retention element 208. The cable retention elements 208 are attached to the cables 108. For example, the cable retention elements 208 may be crimped to the outer surfaces of the cables 108 to clamp the cable retention elements 208 to the cables 108. Alternatively, the cable retention elements 208 may be affixed to the cables 108 using other methods such as, for example, an adhesive. As described below, the cable retention elements 208 prevent the cables 108 from being removed from the housing 106 (shown in FIG. 1).

Each cable retention element 208 includes a body 210 joined to a plurality of wings 212. While two wings 212 are joined to each of the bodies 210, a different number of wings 212 may be coupled to the body 210. For example, a single wing 212 or three or more wings 212 may be joined to each body 210. Alternatively, instead of discrete wings 212 protruding from the body 210, a collar or ledge (not shown) may extend from the body 210 around all or a portion of the body 210. As shown in FIG. 2, when the cable retention element 208 is coupled with the cable 108, the body 210 is an approximately circular collar that surrounds most or all of an outer circumference of the cable 108. As shown in FIG. 3, prior to coupling the cable retention element 208 with the cable 108, the body 210 has an approximate U-shape. Additionally, prior to crimping the body 210 onto the cable 108, the body 210 has a planar body extends between opposite ends 214, 216. After crimping the body 210 onto the cable 108, the ends 214, 216 meet one another at a seam 218.

As shown in FIG. 2, the wings 212 protrude from the body 210 to outer wing ends 220. The wings 212 extend from the body 210 in directions that are angled with respect to the cable 108 and the cable axis 126. The wings 212 may extend from the body 210 in directions that are approximately perpendicular to the cable 108 and the cable axis 126. The distance that is spanned or encompassed by the wings 212 is referred to as a wingspan 222 of the cable retention element 208. In the illustrated embodiment, the wingspan 222 is measured in a direction perpendicular to the cable axis 126. The wings 212 also have a height dimension 224 that is measured in a direction perpendicular to the direction in which the wingspan 222 is measured. For example, the height dimension 224 of the wings 212 can be measured in a direction perpendicular to the direction in which the wings 212 protrude from the body 210.

In order to affix the cable retention element 208 to the cable 108, the cable 108 is placed into a cradle portion 226 of the cable retention element 208. Once the cable 108 is located in the cradle portion 226, the outer ends 214, 216 are moved toward one another to crimp the body 210 onto the cable 108. As described above, the outer ends 214, 216 are moved toward one another to form the seam 218. In the illustrated embodiment, the cable retention element 208 is coupled to the cable 108 without cutting into or otherwise displacing any part of the cable 108. For example, the cable retention element 208 does not cut into or displace the insulative sheath disposed around the exterior of the cable 108. Alternatively, the cable retention element 208 may cut into or displace a portion of the cable 108 in order to affix the cable retention element 208 to the cable 108. For example, the cable retention element 208 may displace some of the insulative sheath when the cable retention element 208 is crimped onto the cable 108.

Figure 4:
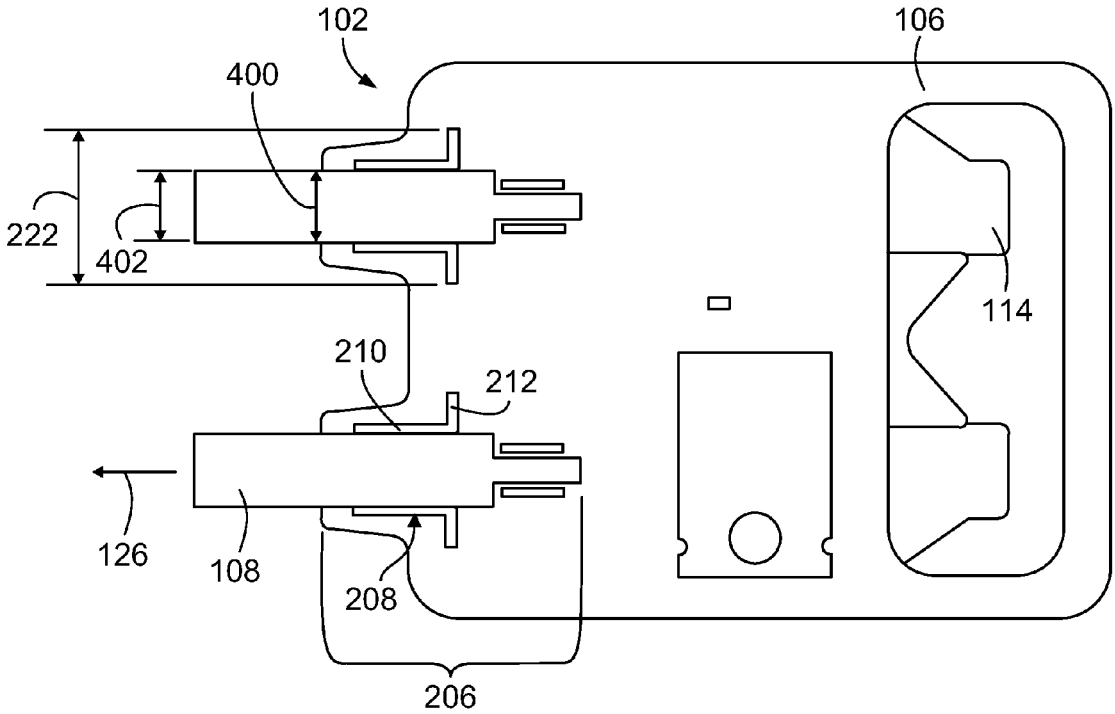
FIG. 4 is a cross-sectional view of a connector assembly shown in FIG. 1 in accordance with one embodiment.

FIG. 4 is a cross-sectional view of the connector assembly 102 taken along line 4-4 shown in FIG. 1 in accordance with one embodiment. The cable retention element 208 is located within the housing 106. As shown in FIG. 4, the end portion 206 of the cable 108 and the entire cable retention element 208 is encapsulated within the housing 106. Alternatively, less than the entire cable retention element 208 may be located within the housing 106. For example, one or more of the wings 212 can be enclosed within the housing 106 while at least a portion of the body 210 is located outside of the housing 106.

The housing 106 is overmolded around the cable retention elements 208 in one embodiment. For example, all or a section of the end portions 206 of the cable retention elements 208 may be placed into a mold along with one or more additional components of the connector assembly 102 (for example, the contacts 114). A dielectric material such as a polymer is placed into the mold over the cable retention elements 208 to surround at least the wings 212 of the cable retention elements 208. Once the dielectric material cures, the housing 106 is overmolded over at least a portion of the cable retention elements 208 to encapsulate at least a portion of the cable retention elements 208 within the housing 106.

The cable retention element 208 engages the housing 106 to prevent the cable 108 from being removed from the housing 106. For example, the cable retention element 208 may secure the cable 108 to the housing 106 such that the force that is applied along the cable axis 126 and that is required to separate the cable 108 from the housing 106 is increased. The wings 212 may be sealed within the overmolded housing 106 to prevent removal of the cable 108 from the housing 106 in a direction along the cable axis 126. In the illustrated embodiment, the wingspan 222 of the cable retention element 208 is greater than an inside diameter 400 of the cable port 136 in the housing 106. The wingspan 222 exceeds the inside diameter 400 in a direction that is approximately parallel to the top side 120 (shown in FIG. 1) and/or the mounting side 118 (shown in FIG. 1) of the housing 106. The greater width of the wings 212 provides additional resistance to removing the cable 108 and cable retention element 208 from the housing 106.

The wings 212 extend from the body 210 in the plane of the housing 106. For example, the wings 212 protrude from the body 210 in directions approximately parallel to the top side 120 (shown in FIG. 1) and/or the mounting side 118 (shown in FIG. 1) of the housing 106. In one embodiment, the height dimension 224 (shown in FIG. 2) of the wings 212 is no greater than the profile height dimension 116 (shown in FIG. 1) of the housing 106. For example, the wings 212 may be sufficiently small in a direction extending approximately perpendicular to the top side 120 and/or the mounting side 118 that the wings 212 do not protrude through the top side 120 and/or mounting side 118. In another example, the height dimension 224 of the wings 212 is no greater than an outer diameter 402 of the cable 108. For example, the height dimension 224 may be less than the outer diameter 402 of the cable 108. Using such a relatively small height dimension 224 of the wings 212 may assist in keeping a relatively low profile height dimension 116 of the housing 106. Keeping a relatively low profile height dimension 116 of the housing 106 can be preferable in applications where the connector assembly 102 is used in relatively tight locations or dimensions. For example, low profile height dimensions 116 of the housing 106 may be desired where the connector assembly 102 is mounted to solar panels on the roofs of homes and the like.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector assembly comprising:

a housing holding contacts configured to be electrically joined with a peripheral device, the housing including a cable port disposed at an outer surface of the housing;

a cable extending from the cable port of the housing along a cable axis, the cable electrically coupled with the contacts in the housing; and a cable retention element attached to the cable and at least partially disposed within the housing, the cable retention element including a body joined with the cable and a wing protruding from the body in a direction oriented at an angle with respect to the cable axis, the body extending between opposite ends and wrapped around the cable such that the ends meet at a seam, the wing engaging the housing to prevent the cable from being removed from the housing, wherein the housing is molded over the ends and the wing of the cable retention element.

2. The connector assembly of claim 1, wherein the wing of the cable retention element is encapsulated in the housing.

3. The connector assembly of claim 1, wherein the direction in which the wing extends from the body of the cable retention element is approximately perpendicular to the cable axis.

4. The connector assembly of claim 1, wherein the body of the cable retention element is a collar that approximately surrounds an outer circumference of the cable.

5. The connector assembly of claim 1, wherein the body of the cable retention element clamps onto the cable to secure the cable retention element to the cable.

6. The connector assembly of claim 1, wherein the cable retention element comprises a plurality of the wings extending from the body of the cable retention element to corresponding outer wing ends.

7. The connector assembly of claim 6, wherein a wingspan extending across the wings exceeds an inside diameter of the cable port in the housing.

8. The connector assembly of claim 1, wherein the housing includes a mounting side configured to be mounted to the peripheral device and an opposite top side, further wherein the direction in which the wing protrudes from the body of the cable retention element extends between the mounting side and the top side of the housing.

9. The connector assembly of claim 1, wherein the housing extends between a mounting side and an opposite top side separated from one another by a housing profile dimension in a height direction, further wherein the wing has a height dimension along the height direction that is less than the housing profile height.

10. The connector assembly of claim 1, wherein the housing is overmolded onto an end portion of the cable and the wing of the cable retention element to encapsulate the end portion of the cable and the wing within the housing.

11. The connector assembly of claim 1, wherein the housing includes a mounting side configured to be mounted to the peripheral device and an opposite top side, further wherein the cable axis is approximately parallel to the mounting side and the top side.

12. The connector assembly of claim 1, wherein the housing engages the cable at the cable port of the housing.

13. The connector assembly of claim 1, wherein the ends of the cable retention element include serrated edges that engage each other at the seam.

14. An electrical connector assembly comprising:

a housing holding contacts configured to be electrically joined with a peripheral device, the housing including a cable port disposed at an outer surface of the housing;

a cable extending from the cable port of the housing, the cable electrically coupled with the contacts in the housing; and a cable retention element attached to the cable and at least partially disposed within the housing, the cable retention element extending between opposite ends and wrapped around the cable such that the ends meet at a seam, the cable retention element including wings protruding from the cable retention element to corresponding outer wing ends, wherein a wingspan extending from one outer wing end to another outer wing end is greater than an inside diameter of the cable port and the housing is molded over the wings and the seam of the cable retention element.

15. The connector assembly of claim 14, wherein the cable extends from the housing along a cable axis and the wings protrude from the cable retention element in directions that are approximately perpendicular to the cable axis.

16. The connector assembly of claim 14, wherein the wings of the cable retention element engage the housing to prevent the cable from being removed from the housing.

17. The connector assembly of claim 14, wherein the cable retention element comprises a body joined to an outer surface of the cable, wherein the wings protrude from the body.

18. The connector assembly of claim 14, wherein the wings protrude from the cable retention element in opposite directions.

19. The connector assembly of claim 14, wherein the housing includes a mounting side configured to be mounted to the peripheral device and an opposite top side, further wherein the directions in which the wings protrude from the cable retention element extend between the mounting side and the top side of the housing.

20. The connector assembly of claim 14, wherein the housing extends between a mounting side and an opposite top side separated from one another by a housing profile dimension in a height direction, further wherein each of the wings has a height dimension along the height direction that is less than the housing profile height.

21. The connector assembly of claim 14, wherein the housing is overmolded onto an end portion of the cable and the wings of the cable retention element to encapsulate the end portion of the cable and the wings within the housing.

22. The connector assembly of claim 14, wherein the cable extends from the housing along a cable axis and the housing includes a mounting side configured to be mounted to the peripheral device and an opposite top side, further wherein the cable axis from the housing is approximately parallel to the mounting side and the top side.

23. The connector assembly of claim 14, wherein the housing engages the cable at the cable port of the housing.

24. The connector assembly of claim 14, wherein the ends of the cable retention element include serrated edges that engage each other at the seam.

* * * * *